US007059839B2

(12) United States Patent
Haller et al.

(10) Patent No.: US 7,059,839 B2
(45) Date of Patent: Jun. 13, 2006

(54) HORIZONTAL COMPRESSOR END CAP WITH A TERMINAL, A VISUALLY TRANSPARENT MEMBER, AND A HEATER WELL MOUNTED ON THE END CAP PROJECTION

(75) Inventors: David K. Haller, Adrian, MI (US); Robin G. Skinner, Tecumseh, MI (US)

(73) Assignee: Tecumseh Products Company, Tecumseh, MI (US)

( * ) Notice: Subject to any disclaimer, the term of this patent is extended or adjusted under 35 U.S.C. 154(b) by 232 days.

(21) Appl. No.: 10/704,037

(22) Filed: Nov. 7, 2003

(65) Prior Publication Data

US 2004/0118146 A1 Jun. 24, 2004

Related U.S. Application Data

(60) Provisional application No. 60/432,190, filed on Dec. 10, 2002.

(51) Int. Cl.
*F04B 17/02* (2006.01)

(52) U.S. Cl. ..... 417/410.3; 417/423.14; 417/63; 184/6.16; 184/6.22

(58) Field of Classification Search ..... 417/423.14, 417/410.3, 63; 184/6.16, 6.22
See application file for complete search history.

(56) References Cited

U.S. PATENT DOCUMENTS 3,213,263 A 10/1965 Steenbergen ..... 219/205
3,476,308 A * 11/1969 Randall et al. ..... 417/415
4,066,869 A 1/1978 Apaloo et al. ..... 219/490
4,557,677 A 12/1985 Hasegawa ..... 418/63
4,792,288 A 12/1988 Gromoll et al. ..... 417/278
4,815,947 A 3/1989 Okoma et al. ..... 417/410
5,007,807 A * 4/1991 Gannaway ..... 417/363
5,062,277 A 11/1991 Heitmann et al. ..... 62/193
5,103,648 A 4/1992 Barbier ..... 62/126
5,110,268 A 5/1992 Sakurai et al. ..... 417/410
5,222,885 A * 6/1993 Cooksey ..... 418/96
5,295,359 A 3/1994 Reilly, Jr. et al. ..... 62/125
5,328,344 A 7/1994 Sato et al. ..... 418/85
5,579,651 A 12/1996 Sugiyama et al. ..... 62/469
5,645,408 A 7/1997 Fujio et al. ..... 418/55.4
5,765,994 A 6/1998 Barbier ..... 417/12
5,829,959 A 11/1998 Tsubono et al. ..... 418/55.5

(Continued)

FOREIGN PATENT DOCUMENTS

JP 6017781 1/1994

*Primary Examiner*—Timothy S. Thorpe
*Assistant Examiner*—Emmanuel Sayoc
(74) *Attorney, Agent, or Firm*—Baker & Daniels

(57) ABSTRACT

A substantially horizontal compressor including a housing having a main body portion with an open end. An end cap is secured to the main body portion with the end cap being provided with a plurality of apertures. The hermetic terminal body of the compressor is sealably fitted into one of the plurality of apertures located in the end cap. One of the apertures is sealably fitted with a heater well in which a substantially cylindrical heater element is removably received. A third aperture may be provided in the end cap in which a sight glass is sealably secured for checking the oil level in the oil sump. An indentation is formed in the end cap to increase the rigidity of the end cap. The proximity of the terminal assembly and heater well allows the wiring therefor to be part of the same wiring harness.

15 Claims, 4 Drawing Sheets

U.S. PATENT DOCUMENTS 5,879,138 A 3/1999 Arndt et al. ..... 417/244
5,931,620 A 8/1999 Sugai et al. ..... 411/82
5,937,659 A 8/1999 Weyna et al. ..... 62/84
5,964,581 A 10/1999 Iizuka et al. ..... 417/410.3
6,082,972 A 7/2000 Moore, Jr. et al. ..... 417/63
6,139,295 A 10/2000 Utter et al. ..... 418/55.6
6,155,805 A * 12/2000 Fry ..... 417/415
6,164,934 A 12/2000 Niihara et al. ..... 417/423.14
6,171,076 B1 1/2001 Gannaway ..... 417/350
6,203,290 B1 3/2001 Tamura et al. ..... 417/410.3
6,264,446 B1 7/2001 Rajendran et al. ..... 418/55.6
6,276,901 B1 8/2001 Farr et al. ..... 417/13
6,302,654 B1 10/2001 Millet et al. ..... 417/63
6,361,281 B1 3/2002 Wurth et al. ..... 417/63
6,361,293 B1 3/2002 Harper et al. ..... 417/363
6,527,085 B1 * 3/2003 Paczuski ..... 184/6.16
6,582,207 B1 * 6/2003 Matsumoto et al. ..... 417/410.1
6,616,428 B1 * 9/2003 Ebara et al. ..... 418/11
6,637,550 B1 * 10/2003 Koyama et al. ..... 184/6.16
2002/0051716 A1 5/2002 Seo ..... 417/415
2002/0159904 A1 * 10/2002 Ebara et al. ..... 418/11

* cited by examiner

HORIZONTAL COMPRESSOR END CAP WITH A TERMINAL, A VISUALLY TRANSPARENT MEMBER, AND A HEATER WELL MOUNTED ON THE END CAP PROJECTION

CROSS REFERENCE TO RELATED APPLICATIONS

This application claims priority under 35 U.S.C. 119(e) of U.S. provisional patent application Ser. No. 60/432,190 filed on Dec. 10, 2002 entitled HORIZONTAL COMPRESSOR END CAP the disclosure of which is hereby incorporated by reference.

BACKGROUND OF THE INVENTION

The present invention relates to substantially horizontal hermetic compressors, and more particularly to the compressor housings and the mounting of components such as the terminal assembly, a sight glass, and a heater in the housing.

In general, the housing of a substantially horizontal hermetic compressor may include a substantially cylindrical main body portion and a pair of end caps mounted to each end of the main body portion. Alternatively, one of the end caps may be integrally formed with the main body portion. A motor and a compression mechanism are mounted in the main body portion. The motor has a plurality of lead wires electrically connected thereto. The lead wires are then electrically connected to a terminal assembly mounted in the compressor housing. The terminal assembly is electrically connected to an external power source to provide the motor with electrical current.

An oil sump is formed in the lower portion of the compressor housing. Components, such as a sight glass or heater, may be mounted in the compressor housing to be in communication with oil in the oil sump. The sight glass is mounted in the housing at a position where the oil in the sump is visible. This allows the operator to visually determine whether there is sufficient oil in the compressor.

A heater may be mounted in the housing to warm the oil in the sump, to facilitate startup under cold conditions and prevent conditions such as foaming. Typically, after shutdown of the compressor, the pressure and temperature of the refrigerant vapor and oil in the compressor housing equalize and tend to mix. Upon startup of the compressor, the temperature and pressure increase and the mixture is agitated, causing the mixture to foam, limiting the amount of oil available to the compressor components. The heater is provided to maintain the temperature of the oil at a level different than that of the refrigerant after shutdown. By maintaining different oil and refrigerant temperatures, foaming upon startup of the compressor is prevented. Additionally, the viscosity of the oil increases as the temperature in the compressor housing decreases, causing the oil to resist flowing easily upon startup. By heating the oil, the viscosity of the oil can be controlled to more desirable levels.

The components typically mounted in the compressor housing include the terminal assembly, and perhaps a sight glass and/or a heater. In previous compressors, at least one of these components is mounted in the substantially cylindrical main body portion of the compressor housing. In order for the component to sealingly engage the outer surface of the housing main body portion, a flat, raised portion is formed therein. The flat, raised portion is provided with an aperture to receive the component and the flat surface defined by the raised portion provides a sealing surface to which the component is secured.

A problem with this type of housing construction includes mounting the components in different portions of the housing. For example, at least one component is mounted in the main body portion and at least one component is mounted in an end cap. Multiple assembly and welding operations are then required on different housing portions, which increases the complexity of assembly and thus the cost of assembly of the compressor.

Additionally, in order to accommodate components in the main body portion of the housing, modifications to the substantially cylindrical main body portion must be made to accommodate component mounting. For example, if above-described apertured, flat surface is not provided, sealing of the component to the cylindrical main body portion may be difficult to achieve, and may result in a potential leakage point in the housing. Further, manufacturing of the main body portion to accommodate the components is often complex, time consuming and expensive.

Further, the motor and/or the compression mechanism may be shrink-fitted into the cylindrical main body portion of the housing. During the shrink-fit operation, distortion of the main body portion at locations where these components are mounted may occur, creating problems during or after compressor assembly. Additionally, expansion and contraction of the main body portion during the shrink-fit operation may cause the housing to crack near the mounted components, necessitating scrapping or repairing the housing.

SUMMARY OF THE INVENTION

The invention comprises, in one form thereof, a substantially horizontal compressor that includes a housing having a main body portion with an open end. A motor is mounted in the housing and the housing defines an oil sump containing a lubricating fluid. An end cap is secured to the main body portion open end wherein the housing and the end cap form a hermetically sealed enclosure. A terminal assembly electrically connected with the motor is mounted in the end cap. A projection is also disposed on the end cap and extends into the housing. The projection has an internal volume accessible from a position exterior to the housing wherein the internal volume defines a heater well and the projection is disposed within the oil sump. A visually transparent member is also mounted in the end cap wherein a fluid level of the oil sump is visually determinable from a position exterior to the housing.

At least a portion of the heater well and the visually transparent member may be submersed in the lubricating fluid. The end cap may also include a flanged portion and an end cap body portion wherein the flanged portion is integrally formed with the end cap body portion and the flanged portion engagingly circumscribes an outer surface of the housing main body portion. The end cap body portion may also include a substantially cylindrical sidewall and an end wall wherein the transparent member is located in the sidewall and the terminal assembly and projection are located in the end wall. Further, a fence may be secured to the end cap body portion wherein the terminal assembly and the projection are disposed on a portion of the end cap surrounded by the fence.

The present invention comprises, in another form thereof, a substantially horizontal compressor that includes a housing having a main body portion with an open end and an outer cylindrical surface. A motor is mounted in the housing and the housing defines an oil sump containing a lubricating fluid. An end cap engagingly circumscribes the outer cylindrical surface of the housing main body portion proximate the open end wherein the housing and the end cap form a hermetically sealed enclosure. A terminal assembly electrically connected to the motor is mounted in the end cap. A projection is disposed on the end cap and extends into the housing. The projection has an internal volume accessible from a position exterior to the housing wherein the internal volume defines a heater well. The projection is disposed within the oil sump. Additionally, a fence is secured to the end cap body portion wherein the terminal assembly and the projection are disposed on a portion of the end cap surrounded by the fence.

The invention comprises, in yet another form thereof, a method of assembling a housing for a substantially horizontal compressor. The method includes mounting a motor in a main body portion of the housing, forming a plurality of apertures in an end cap and mounting a terminal assembly and a transparent member in respective ones of the plurality of apertures. The method also includes providing a projection on the end cap, the projection having an internal volume defining a heater well and securing the end cap to the main body portion of the housing wherein the projection extends into the housing and the heater well is accessible from a position exterior to the housing and the housing and end cap form a hermetically sealed enclosure, and removably disposing a heater element in the heater well.

The method may also include securing a fence to an outer surface of the end cap wherein the fence surrounds the terminal assembly and heater well. The method may further include passing wires electrically connected to the terminal assembly and heater element through an enclosure formed by the fence and a protective cap removeably secured to the fence, the wires electrically connectable to an external power source.

One advantage of the present invention is that it avoids the need to place component mounting surfaces and holes in a cylindrical housing body. This reduces the potential for leaks and thereby improves the compressor reliability. This also reduces the possibility of cracking and other damage to the cylindrical housing body during manufacture thereby reducing scrap and promoting manufacturing efficiency.

Another advantage of the present invention is that assembly of the compressor is simplified by mounting these components to the housing in a single assembly and welding operation, thus reducing the cost of manufacturing of the compressor. Additionally, fewer assembly or welding jigs are required to manufacture the compressor.

A further advantage afforded by the present invention is that the wiring harness may be preassembled, including the electrical connectors for the terminal assembly and the heater element, which may be connected at the same time and place, thereby reducing handling and speeding assembly time. Further, proximally locating the terminal body and heater element affords a shorter harness, minimizing the lengths of the wire needed therefor. Locating the terminal body and heater well in proximity also allows both the terminal body and heater element to be surrounded by a common fence secured to the end cap.

BRIEF DESCRIPTION OF THE DRAWINGS

The above-mentioned advantages, and other features and objects of this invention, and the manner of attaining them, will become more apparent and the invention itself will be better understood by reference to the following description of an embodiment of the invention taken in conjunction with the accompanying drawings, wherein.

Figure 1:
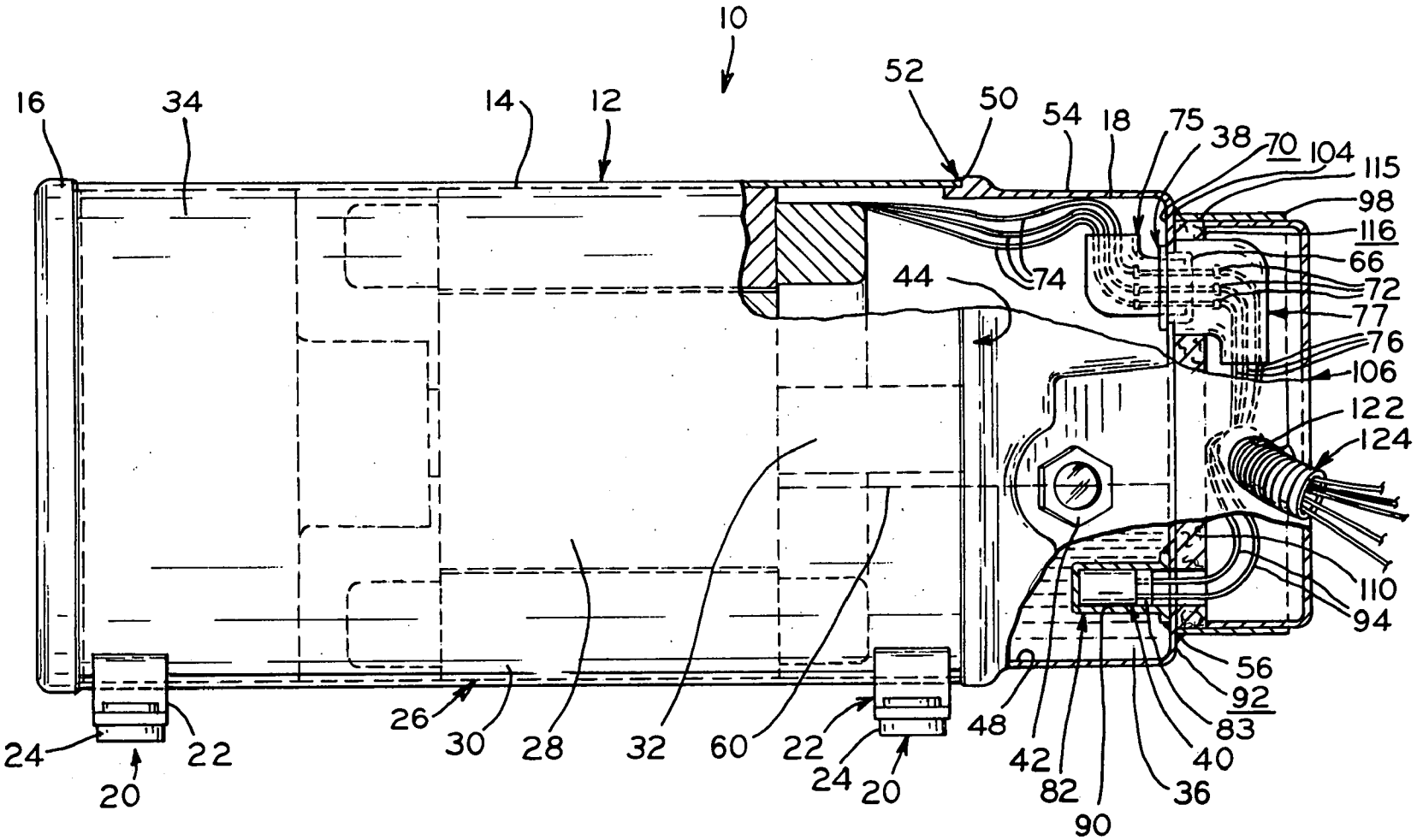
FIG. 1 is a partially sectioned, side view of a substantially horizontal compressor in accordance with the present invention.

Corresponding reference characters indicate corresponding parts throughout the several views. Although the drawings represent an embodiment of the present invention, the drawings are not necessarily to scale and certain features may be exaggerated in order to better illustrate and explain the present invention.

DETAILED DESCRIPTION OF THE INVENTION

Referring to FIG. 1, compressor 10 is a substantially horizontal hermetic compressor including housing 12. Housing 12 includes substantially cylindrical main body portion 14 having end caps 16 and 18 mounted thereto by any suitable method including welding, brazing, or the like. Housing 12 may be constructed from any suitable metal including steel or the like, able to withstand the generally well known operating conditions of prior compressors. The housing end caps may be formed by stamping, and the cylindrical main portion may be roll formed and welded, for example. Alternatively, end cap 16 may be integrally formed with the cylindrical main portion by a deep-drawing operation, for example.

Figure 2:
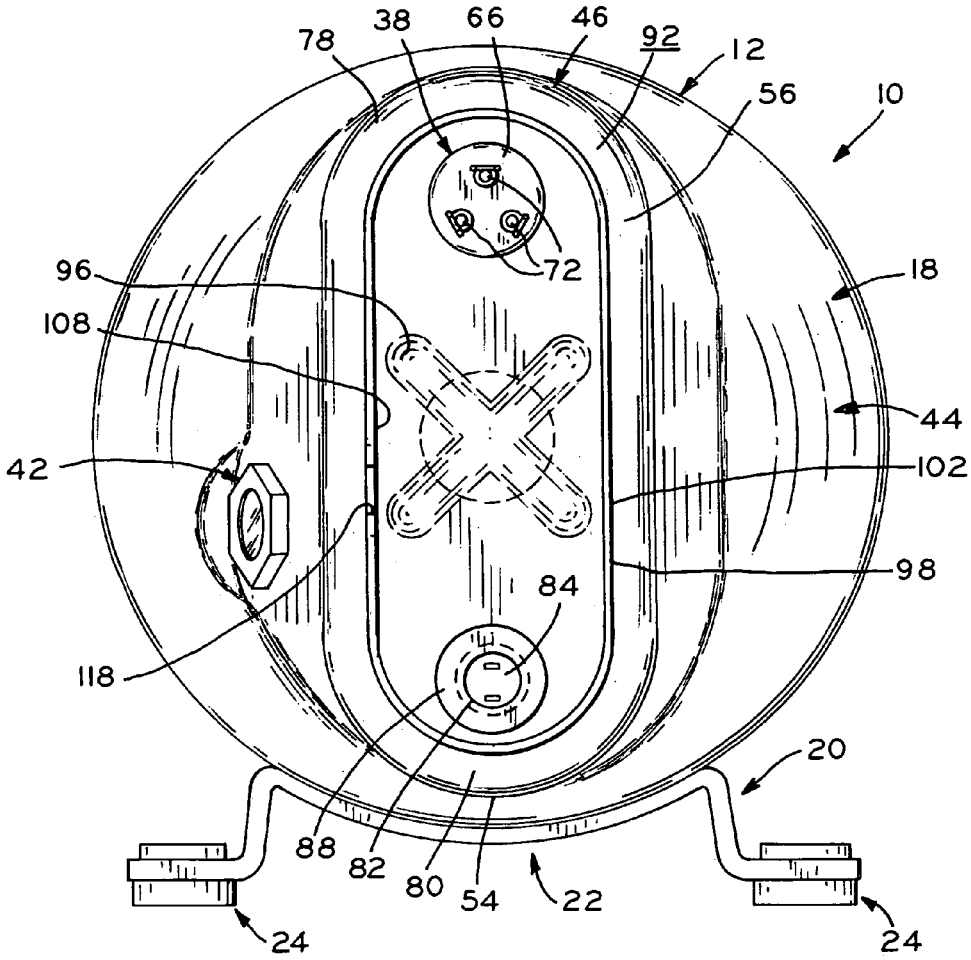
FIG. 2 is an end view of the compressor of FIG. 1 without the end cap cover.

Referring to FIGS. 1 and 2, compressor 10 is oriented in a substantially horizontal position being supported on mounts 20. Mounts 20 each include support portion 22 shaped to engage a portion of the outer surface of housing main body portion 14. Feet 24 are integrally formed with each support portion 22 and engage the surface on which compressor 10 is mounted.

As illustrated in FIG. 1, compressor 10 includes motor 26 having rotor 28 and stator 30 secured within housing main body portion 14. Drive shaft 32 is supported within rotor 28 for rotation therewith. Secured to one end of drive shaft 32 is compression mechanism 34 which may be of any suitable type known in the art including a scroll, reciprocating, or rotary compressor mechanism.

The general structure and operation of a rotary compressor is disclosed in U.S. Pat. Nos. 5,222,885 and 6,361,293. The general structure and operation of a scroll compressor is disclosed in U.S. Pat. No. 6,139,295. The disclosures of these documents are expressly incorporated herein by reference.

As is typical, located at the end of drive shaft 32 opposite the compression mechanism is an oil pump (not shown). The oil pump is in fluid communication with oil sump 36 defined in housing 12. In general, operation of motor 26 induces rotation of drive shaft 32, which in turn drives compression mechanism 34 to compress refrigerant drawn into compressor 10. The oil pump draws oil from oil sump 36 into drive shaft 32 to supply oil to bearing surfaces in the compressor in any of several previously known ways.

Referring to the figures, compressor 10 is provided with a plurality of components mounted to the housing, including terminal assembly 38, heater element 40, and sight glass 42.

These components are all mounted in end cap 18 to facilitate realization of the above-described advantages.

End cap 18 includes integrally-formed flanged portion 44 and body portion 46. Flanged portion 44 is located about the elliptical periphery of opening 48 of body portion 46, and engages end 50 of cylindrical main body portion 14. Flanged portion 44 is secured to body portion 14 at 52 by welding, brazing, or the like, as is known in the art. When end cap 18 is assembled to main body portion 14, body portion 46 defines a portion of oil sump 36.

Figure 3:
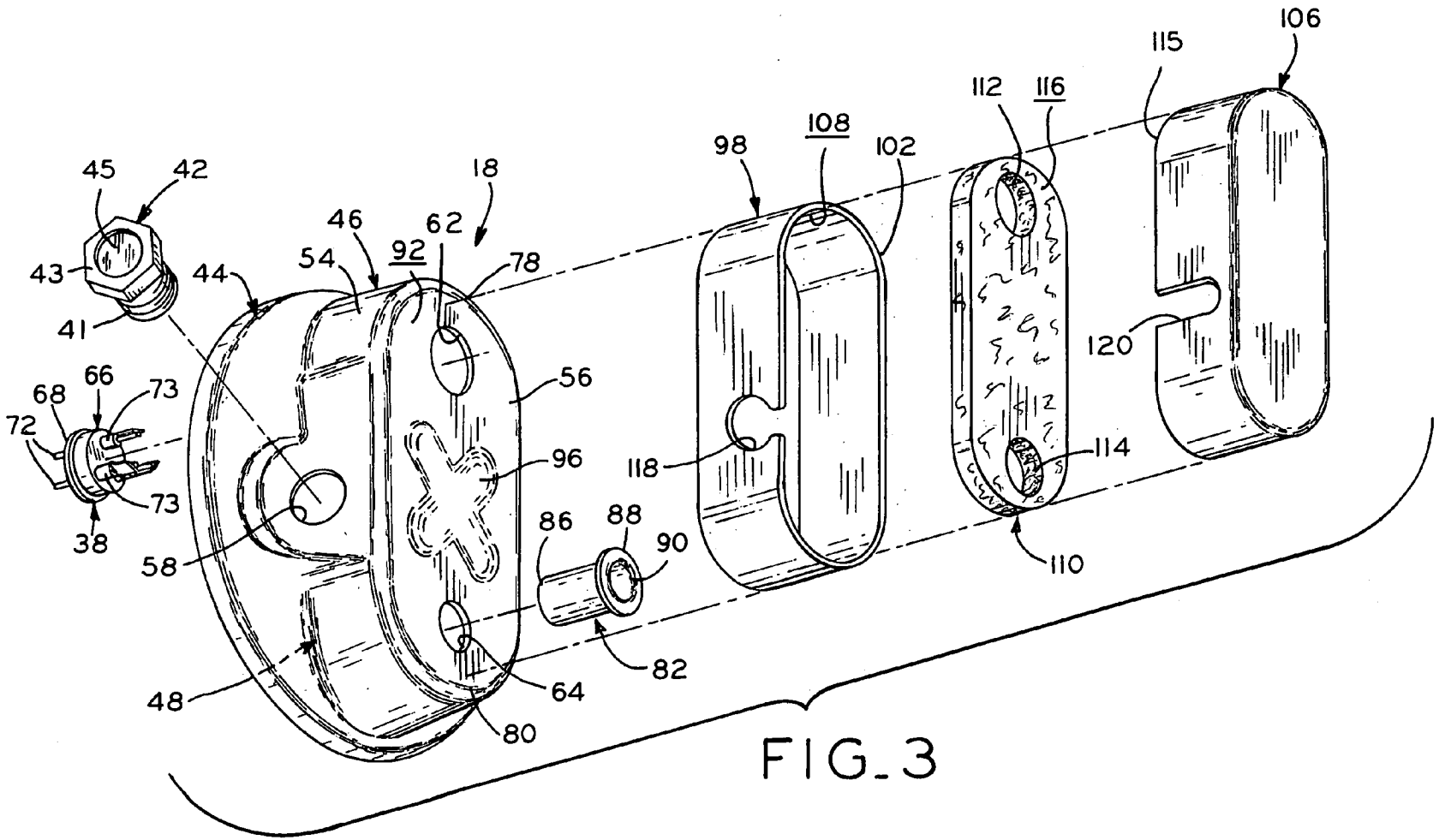
FIG. 3 is an exploded perspective view of the end cap and cover of the compressor of FIG. 1.

Body portion 46 of end cap 18 is provided with a plurality of apertures in which terminal assembly 38, the well for heater element 40, and sight glass 42 are mounted. Referring to FIG. 3, body portion 46 is somewhat elongated diametrically, having sidewall 54 defining a substantially oval cross-sectional shape, and end wall 56.

Aperture 58 shown in FIG. 3 is formed in sidewall 54 for receiving sight glass 42. Aperture 58 is positioned in sidewall 54 so that oil is normally visible through sight glass 42, allowing an operator to monitor level 60 of oil in sump 36. In the illustrated embodiment, sight glass 42 includes a hollow threaded shaft 41, a hexagonal shaped head 43 and a transparent sighting member 45 such as a sealingly mounted glass sheet. Illustrated sight glass 42 is secured in end cap 18 by threaded engagement, however, other suitable means such as welding, brazing, or the like may also be used to secure a sight glass member in end cap 18.

Apertures 62 and 64 illustrated in FIG. 3 are formed in body portion end wall 56 for receiving terminal assembly 38 and the well for heater element 40, respectively. Terminal assembly 38 is of a well-known type and includes cup-shaped terminal body 66 having flanged portion 68 which engages interior surface 70 of cap 18. A plurality of conducting pins 72 are sealably mounted in terminal body 66 by insulators 73 (FIG. 4) located therebetween. Insulators 73 are typically constructed from fused glass which electrically insulate pins 72 from body 66. Referring to FIG. 1, lead wires 74 are electrically connected at one end to stator 30 of motor 26, and are each connected at their opposite ends to the interior ends of pins 72, located inside housing 12. The ends of wires 74 connecting to pins 72 are housed in connector assembly 75 (FIGS. 1 and 4) to protect the connection from carbon deposits created during compressor operation. As described further hereinbelow, the external ends of pins 72 are electrically connected to an external power source (not shown) via connector assembly 77 housing a portion of wires 76 of a wiring harness. Electrical power from the external power source travels through wiring harness wires 76, conducting pins 72, and lead wires 74 to the windings of motor stator 30 to operate motor 26.

Aperture 62 is formed near upper end 78 of elongated end wall 56. End 78 is positioned near the top of housing 12 so that terminal assembly 38 is located above oil level 60 and will not be submerged in oil stored in sump 36. After being placed in aperture 62, terminal assembly 38 is secured to end cap 18 by welding, brazing, or the like.

Heater element 40 is received in the blind fitting or well 82. The illustrated fitting 82 is a blind cylindrical fitting that is sealably fixed within aperture 64. Heater element 40 is secured in well 82 by packing material 83 (FIGS. 1 and 4) which may be any suitable material, such as an insulative, waterproofing putty. Aperture 64 is located at lower end 80 of end wall 56 in oil sump 36. Heater well 82 is constructed from any suitable heat conducting metal which can be secured to end cap 18. Referring to FIGS. 1 and 3, heater well 82 is substantially cylindrical having closed base 86 and flange 88 disposed about the periphery of open end 90. Flange 88 abuts inner surface 70 (FIGS. 1 and 4) or outer surface 92 (FIG. 3) of end cap 18, and is secured thereto by welding, brazing, or the like, the well extending into the oil sump at a location below the oil surface level. Heater well 82 then slidably receives substantially cylindrical heater element 40 having electrical wires 94 included in the harness which includes wires 76. Power is applied to heater element 40 in any conventional manner, selectively or continuously. Due to the proximity of terminal assembly 38 and heater element 40, the wiring of compressor 10 may be simplified with wires 76 and 94 being preassembled into a common wiring harness before the harness being received by the compressor assembler. The heater element may be a component of the wiring harness, or may be a separate component which is electrically connected to the harness at the time the power connection to the terminal assembly is made.

Heater element 40 is provided to warm the oil in oil sump 36 to facilitate startup of compressor 10 under cold conditions in outdoor applications, for example. By providing heater element 40 to warm the oil, the viscosity of the oil is controlled, the oil may more easily flow to the lubrication points, the rotor may more easily rotate, and conditions such as foaming can be prevented. However, if compressor 10 is located in an environment where the temperature of the oil is maintained substantially at or above room temperature, heat element 40 may not be necessary. In such an indoor application, heater element 40 may be omitted, and heater well 82 left empty. The wiring harness may thus be provided with and without wires 94 and/or heater element 40.

By mounting the hardware components in end cap 18, main body portion 14 need not be provided with holes or a flat portion for mounted the terminal assembly, sight glass, or heater well. The elimination of the holes and flat portions reduces the potential for cracking or deformation of the housing around the aperture during assembly and operation which would prevent sealing between the components and the housing and potentially generate scrap during manufacture. Therefore, the potential for leaks is reduced, improving the compressor reliability and scrap may also be reduced thereby promoting efficiency of the manufacturing process.

As illustrated in FIGS. 2 and 3, end cap 18 may also be provided with indentation 96 integrally formed in end wall 56. Indentation 96 is provided to stiffen the material of end wall 56 between apertures 62 and 64, adding rigidity to end cap 18 to prevent deformation thereof. Indentation 96 is shown as being formed in the shape of an X, however, other suitable shapes may also be used.

As illustrated, oval-shaped fence 98 is secured to end cap 18 to surround the locations of the heater well and terminal assembly. As shown in FIGS. 1 and 2, fence 98 is smaller than the oval outline of body portion 46, but has substantially the same oval shape. Fence 98 is constructed from a suitable material, e.g., by forming a sheet of metal material, and is secured to end cap outer surface 92 by any suitable method including being welded or brazed at 104 (FIG. 1). After the installation of fence 98, compressor 10 is painted. The wiring harness is subsequently installed.

As shown in FIGS. 1 and 3, protective cap 106 is provided to close open end 102 of fence 98 after connection of the wiring harness. Protective cap 106 is constructed from a plastic material by a method such as injection molding, for example, and is sized to slidably engage inner surface 108 of fence 98. Protective cap 106 may be secured to fence 98 by any suitable method including being interference or snap fitted therein, or being secured thereto with fasteners (not shown). Insulation 110 is received within fence 98, with apertures 112 and 114 in insulation 110 being positioned to surround at least a portion of terminal assembly 38 and heater element 40. Protective cap 106 is inserted into fence 98 until edge 115 of cap 106 compresses surface 116 of insulation 110. Fence 98 is provided with slot 118 which aligns with slot 120 in protective cap 106 to define passage 122 (FIG. 1) through which the wiring harness passes.

Figure 4:
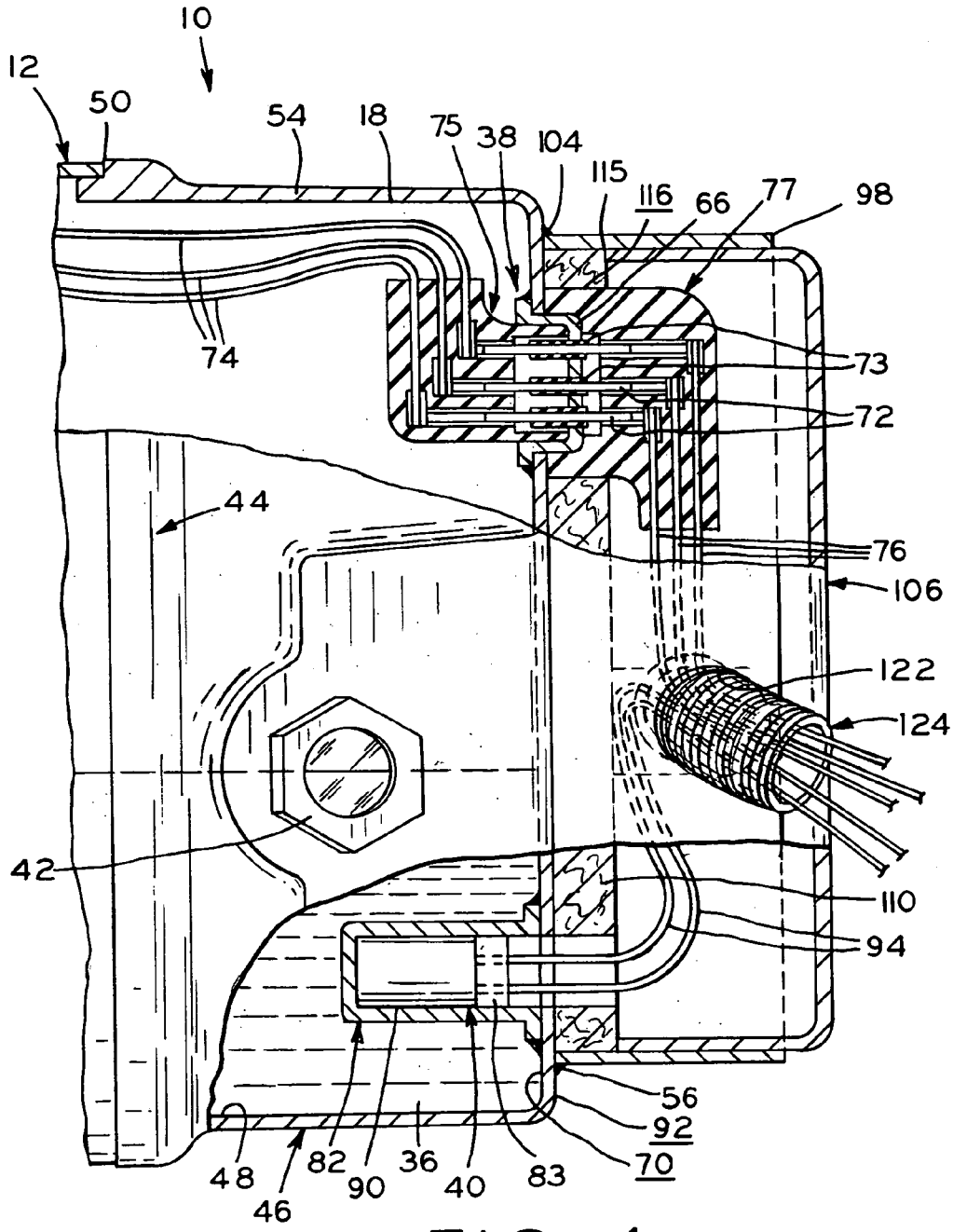
FIG. 4 is an enlarged, fragmentary view of the compressor of FIG. 1.

Referring to FIGS. 1 and 4, wires 76 and 94 of the wiring harness extending through passage 122 defined by fence 98 and cap 106 are covered by ribbed sheathing 124 constructed from any suitable material such as plastic. One end of sheathing 124 is force fitted into passage 122 to protect and bundle the wires as they exit passage 122. Sheathing 124 terminates once through passage 122 so that wires 76 and 94 may be respectively directed toward the terminal assembly and heater element locations, which are at diametrically opposite ends of end cap 18.

While this invention has been described as having an exemplary design, the present invention may be further modified within the scope of this disclosure. This application is therefor intended to cover any variations, uses, or adaptations of the invention using its general principles. Further, this application is intended to cover such departures from the present disclosure as come within known or customary practice in the art to which this invention pertains.

What is claimed is:

1. A substantially horizontal compressor comprising:

a housing having a main body portion, said main body portion having an open end;

a motor mounted in said housing and an oil sump containing a lubricating fluid defined by said housing;

an end cap secured to said main body portion open end wherein said housing and said end cap form a hermetically sealed enclosure;

a terminal assembly mounted in said end cap, said terminal assembly electrically connected with said motor;

a projection disposed on said end cap and extending into said housing, said projection having an internal volume accessible from a position exterior to said housing, said internal volume defining a heater well, said projection disposed within said oil sump; and a visually transparent member mounted in said end cap wherein a fluid level of said oil sump is visually determinable from a position exterior to said housing.

2. The compressor of claim 1, further comprising a heater element, said heater element received in said heater well.

3. The compressor of claim 2, wherein at least a portion of said heater well and said visually transparent member is submersed in said lubricating fluid.

4. The compressor of claim 1, wherein said end cap further comprises a flanged portion and an end cap body portion, said flanged portion integrally formed with said end cap body portion, said flanged portion engagingly circumscribing an outer surface of said housing main body portion.

5. The compressor of claim 4, wherein said end cap body portion further comprises a substantially cylindrical sidewall and an end wall, said transparent member located in said sidewall; said terminal assembly and said projection located in said end wall.

6. The compressor of claim 5, further comprising an indentation formed in said end wall of said end cap body portion whereby rigidity of said end cap body portion is enhanced.

7. The compressor of claim 4, further comprising a fence secured to said end cap body portion, said terminal assembly and said projection disposed on a portion of said end cap surrounded by said fence.

8. The compressor of claim 7, further comprising a protective cap removeably secured to said fence, said protective cap and said fence enclosing said terminal assembly and said projection.

9. The compressor of claim 8, further comprising an insulative material located between said end cap body portion and said protective cap.

10. A substantially horizontal compressor comprising:

a housing having a main body portion, said main body portion having an open end and an outer cylindrical surface;

a motor mounted in said housing and an oil sump containing a lubricating fluid defined by said housing;

an end cap engagingly circumscribing said outer cylindrical surface of said housing main body portion proximate said open end wherein said housing and said end cap form a hermetically sealed enclosure;

a terminal assembly mounted in said end cap, said terminal assembly electrically connected to said motor;

a projection disposed on said end cap and extending into said housing, said projection having an internal volume accessible from a position exterior to said housing, said internal volume defining a heater well, said projection disposed within said oil sump; and a fence secured to said end cap body portion, said terminal assembly and said projection disposed on a portion of said end cap surrounded by said fence.

11. The compressor of claim 10, further comprising a heater element, said heater element received in said heater well.

12. The compressor of claim 10, further comprising a visually transparent member mounted in said end cap wherein a fluid level of said oil sump is visually determinable from a position exterior to said housing through said visually transparent member.

13. The compressor of claim 12, wherein said end cap body portion further comprises a substantially cylindrical sidewall and an end wall, said visually transparent member located in said sidewall; said terminal assembly and said heater well located in said end wall.

14. The compressor of claim 13, further comprising an indentation formed in said end wall of said end cap body portion, whereby rigidity of said end cap body portion is enhanced.

15. The compressor of claim 10, further comprising a protective cap removeably secured to said fence, said protective cap and said fence enclosing said terminal assembly and said projection; and an insulative material located between said end cap body portion and said protective cap.

* * * * *